US007360475B2

(12) United States Patent
Quercia

(10) Patent No.: US 7,360,475 B2
(45) Date of Patent: Apr. 22, 2008

(54) STRIPPING DEVICE FOR A PRESS

(76) Inventor: Paolo Quercia, 17990 Antoine Faucon, Pierrefonds, QBC (CA) H9K 1L2

( * ) Notice: Subject to any disclaimer, the term of this patent is extended or adjusted under 35 U.S.C. 154(b) by 103 days.

(21) Appl. No.: 10/872,388

(22) Filed: Jun. 22, 2004

(65) Prior Publication Data

US 2005/0227847 A1 Oct. 13, 2005

Related U.S. Application Data

(63) Continuation-in-part of application No. 10/819,926, filed on Apr. 8, 2004.

(51) Int. Cl.
*B26F 3/00* (2006.01)

(52) U.S. Cl. ..... 83/111; 83/145; 225/93

(58) Field of Classification Search ..... 83/343, 83/663, 117–119, 27, 111, 124, 132, 138–143, 83/347, 145, 146, 128, 129, 53, 102, 113, 83/115, 348, 886, 879; 493/342, 373; 76/107.1, 76/107.8; 225/93, 97, 103

See application file for complete search history.

(56) References Cited

U.S. PATENT DOCUMENTS

| | | | |
|---|---|---|---|
| 336,335 | A | 2/1886 | McDonald |
| 545,711 | A | 9/1895 | Miller |
| 2,191,836 | A | 2/1940 | Stromberg et al. |
| 2,327,530 | A | 8/1943 | Klopfenstein |
| 3,167,985 | A | 2/1965 | Madsen |
| 3,559,518 | A | 2/1971 | Domka |
| 3,745,808 | A | 7/1973 | Hosaka |
| 3,786,731 | A | 1/1974 | Bobst et al. |
| 3,827,322 | A | 8/1974 | Saudners et al. |
| 3,946,627 | A | 3/1976 | Hofmann |
| 4,015,495 | A | 4/1977 | Yerly |
| 4,024,747 | A | 5/1977 | Bergmann et al. |
| 4,041,847 | A | 8/1977 | Spengler |
| 4,175,477 | A | 11/1979 | Inose et al. |
| 4,295,842 | A | 10/1981 | Bell |
| 4,299,590 | A | 11/1981 | Sasaki |
| 4,306,476 | A | 12/1981 | Saunders et al. |
| 4,371,369 | A | 2/1983 | Wright, III |
| 4,444,075 | A | 4/1984 | Mulry |
| 4,499,802 | A | 2/1985 | Simpson |
| 4,522,095 | A | 6/1985 | Saunders et al. |
| 4,742,742 | A | 5/1988 | Yokoe |
| 4,896,573 | A | 1/1990 | Kapolnek |
| 4,985,012 | A | 1/1991 | Marschke |
| 5,049,122 | A | 9/1991 | Marschke |

(Continued)

*Primary Examiner*—Kenneth E. Peterson
*Assistant Examiner*—Phong Nguyen
(74) *Attorney, Agent, or Firm*—Equinox Protection; Franz Bonsang, Patent Agent

(57) ABSTRACT

A stripping device for stripping a waste piece from a sheet of material, which includes a stripping member with a connecting portion, a supporting finger located on one side of the connecting portion, and a stripping finger located on another side of the connecting portion. The supporting finger has one end connected to a frame and is movable about its end with respect to the frame. The stripping finger has a stripping end portion, which is biased away from the supporting finger and contacts the waste piece at an angle. The supporting finger is deflected away from the waste piece and the stripping end portion is moved further away from the supporting finger and against the waste piece to strip it from the sheet.

46 Claims, 8 Drawing Sheets

U.S. PATENT DOCUMENTS

| | | | | |
|---|---|---|---|---|
| 5,111,725 | A | | 5/1992 | Simpson et al. |
| 5,474,219 | A | | 12/1995 | Mano |
| 5,515,749 | A | | 5/1996 | Sandford |
| 5,520,080 | A | | 5/1996 | Sandford |
| 5,546,839 | A | | 8/1996 | Gardiner |
| 5,605,527 | A | | 2/1997 | Gillieron |
| 5,660,380 | A | | 8/1997 | Reis et al. |
| 5,784,939 | A | | 7/1998 | Rebeaud |
| 5,881,620 | A | | 3/1999 | Smithwick, Jr. et al. |
| 5,896,795 | A | * | 4/1999 | Harhay et al. ..... 83/111 |
| 6,006,636 | A | | 12/1999 | Baldwin et al. |
| 6,050,817 | A | | 4/2000 | Davidovich |
| 6,477,930 | B1 | | 11/2002 | Sandford |
| 6,520,900 | B1 | | 2/2003 | Sandford |
| 6,644,153 | B1 | | 11/2003 | Gordon |
| 7,044,040 | B1 | * | 5/2006 | Smith ..... 83/115 |

* cited by examiner

STRIPPING DEVICE FOR A PRESS

CROSS-REFERENCE TO RELATED APPLICATION

The present application is a Continuation-in-part (C.I.P.) of pending U.S. patent application Ser. No. 10/819,926 filed on Apr. 8, 2004.

FIELD OF THE INVENTION

The present invention concerns mechanical devices, more particularly to mechanical devices for stripping waste from a pre-cut sheet of material.

BACKGROUND OF THE INVENTION

Presses for cutting sheet material such as paper, paperboard, cardboard and the like, are well known. When the sheet material is pre-cut and includes pre-cute portions, which need to be stripped out, the presses include stripping stations. One such stripping station is disclosed in U.S. Pat. No. 3,786,731, issued to Bobst et al. on Jan. 22, 1974 for "Press for Cutting Sheet Material". Bobst discloses stripping stations, which include a pair of frames and a board, which has a series of pre-cut die openings, which are shaped to the desired design. Stripping tools are mounted to the frames and sandwich the waste material between once the sheet material is moved horizontally between the two frames. The stripping tools work together to remove the waste material. One problem, however, the stripping stations may operate too slowly for use with a high throughput stripping. Moreover, paper jams may occur frequently once the waste piece has been removed, thus causing the stripping station to be shut down for a significant time while the jam is removed.

Thus there is a need for an improved stripping device.

SUMMARY OF THE INVENTION

The present invention reduces the difficulties and disadvantages of the aforesaid designs by providing a resilient spring-like stripping device, which can be easily retrofitted into an existing pressing machine to strip waste portions from a pre-cut sheet, without the need for complex machinery. The stripping device is constructed from inexpensive materials such as stainless steel. Advantageously, the previously mentioned problems associated with paper jams is significantly reduced or essentially eliminated by the addition of a either a resiliently movable blocking member or a stationary blocking member, which prevent the waste pieces from interfering with a stripping operation. The inherent resilience of the stripping device enables significantly increased stripping speeds, which increases productivity and decreases stoppage time. Furthermore, the device of the present invention significantly reduces pre-press/on-press make ready times.

In accordance with a first embodiment of the present invention, there is provided a stripping device for stripping a waste piece from a sheet of material, the device comprising: a) a stripping member having a connecting portion, a supporting finger located on one side of the connecting portion, and a stripping finger located on another side of the connecting portion; b) a frame having a planar body having at least one body opening located therein, and a die connected thereto and in register with the body opening, the die having a planar surface substantially facing the stripping finger; c) the supporting finger having a first end connected to the frame, the supporting finger being movable about the first end with respect to the frame; and d) the stripping finger having a stripping end portion, the stripping end portion being disposed towards the body opening in alignment with the die and being biased away from the supporting finger for contacting at an angle the waste piece to be stripped, the stripping end portion being slidable relative to and along the planar surface of the die with the waste piece therebetween to deflect the waste piece as the waste piece moves towards the body opening, the stripping end portion being movable further away from the supporting finger and against the waste piece so as to strip the waste piece, the body opening receiving the waste piece, the stripping end portion slidably and directly contacting the planar surface of the die after stripping of the waste piece.

In accordance with another aspect of the present invention, there is provided a stripping device for use in a die cutting press, for stripping a waste piece from a pre-cut sheet the press having a first frame having at least one frame opening therein and a second frame having at least one punch complementary with the frame opening, the frames being movable with respect to each other, the punch being cooperable with the frame opening, the device comprising: a) a folded over piece of resilient material having a supporting finger located on one side of the fold, and a stripping finger located on another side of the fold, the supporting finger having a first end connected to the first frame, the supporting finger being movable about the first end with respect to the first frame, the stripping finger having a stripping end portion, the stripping end portion being resiliently biased away from the supporting finger for contacting at an angle the waste piece to be stripped, the stripping end portion being slidable along the punch to deflect the waste piece, the stripping end portion being movable further away from the supporting finger and against the waste piece so as to strip the waste piece; b) a blocking member for blocking the waste piece after it has been stripped, the blocking member having a second end resiliently hinged to the frame and a pair of blocking fingers connected to the second end, the blocking fingers being spaced apart to define a gap therebetween, the gap being of sufficient size to permit the stripping end portion to move between the blocking fingers.

In accordance with another aspect of the present invention, there is provided a stripping device for use in a die cuffing press, for stripping a waste piece from a pre-cut sheet, the press having a first frame having at least one frame opening therein and a second frame having at least one punch complementary with the frame opening, the frames being movable with respect to each other, the punch being cooperable with the frame opening, the device comprising: a) a folded over piece of resilient material having a supporting finger located on one side of the fold, and a stripping finger located on another side of the fold, the supporting finger having a first end connected to the first frame, the supporting finger being movable about the first end with respect to the first frame, the stripping finger having a stripping end portion, the stripping end portion being resiliently biased away from the supporting finger for contacting at an angle the waste piece to be stripped, the supporting finger being deflectable away from the waste piece, the stripping end portion being movable further away from the supporting finger; b) an abutment member for blocking the waste piece after it has been stripped, the abutment member having a stationary finger fixedly connected to the second frame, the stationary finger being spaced apart from the punch and defining a blocking gap therebetween, the stationary finger includes a planar surface, the stationary finger being tapered away from the second frame towards the planar surface, the stripping end portion being slidable along the planar surface against the waste piece towards the blocking gap so as to strip the waste piece.

In accordance with yet another aspect of the present invention, there is provided a method of stripping a waste piece from a sheet of pre-cut material, the method comprising: a) biasing a stripping finger away from a supporting finger, the stripping finger being in contact with the waste piece at an angle; b) deflecting the supporting finger away from the waste piece so as to strip the waste piece from the sheet.

BRIEF DESCRIPTION OF THE DRAWINGS

Further aspects and advantages of the present invention will become better understood with reference to the description in association with the following Figures, in which.

DETAILED DESCRIPTION OF THE PREFERRED EMBODIMENTS

Figure 1:
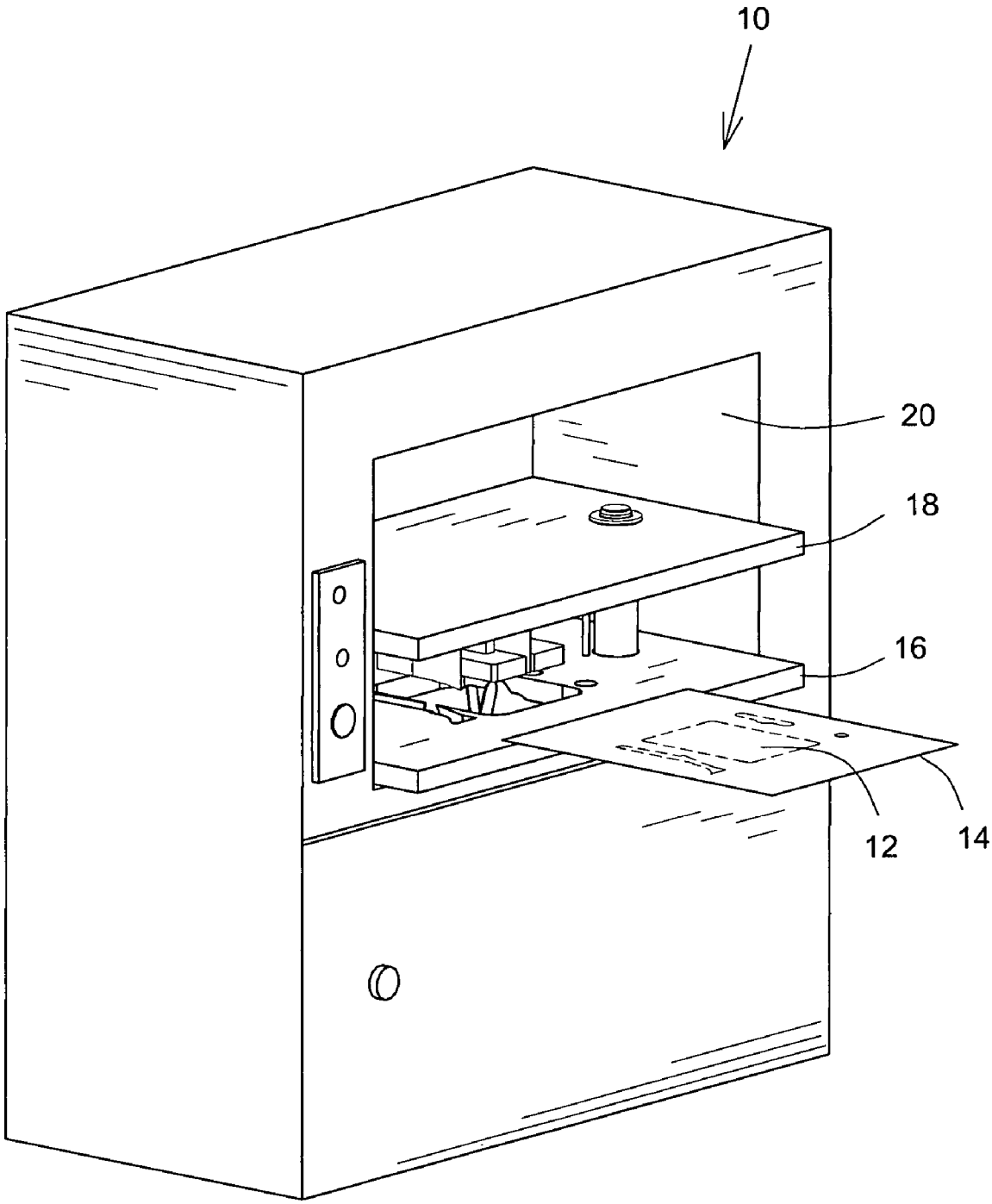
FIG. 1 is a simplified perspective view of a die cutting press with a pair of stripping frames located therein.

Referring now to FIG. 1, a paper press for pressing paper products is shown generally at 10. The press 10 is used to remove waste pieces of material 12 from pre-cut sheets of material 14, which is typically paper, paperboard, cardboard and the like. The pre-cut sheet of material 14 is typically a template for many applications. Examples include, but are not limited to, backing sheets for a blister package, blanks for constructing paperboard cartons and the like. The press 10 is a die-cutting press of a conventional design known to those skilled in the art and includes a pair of planar body press frames 16, 18 mounted within a housing 20.

Figure 2:
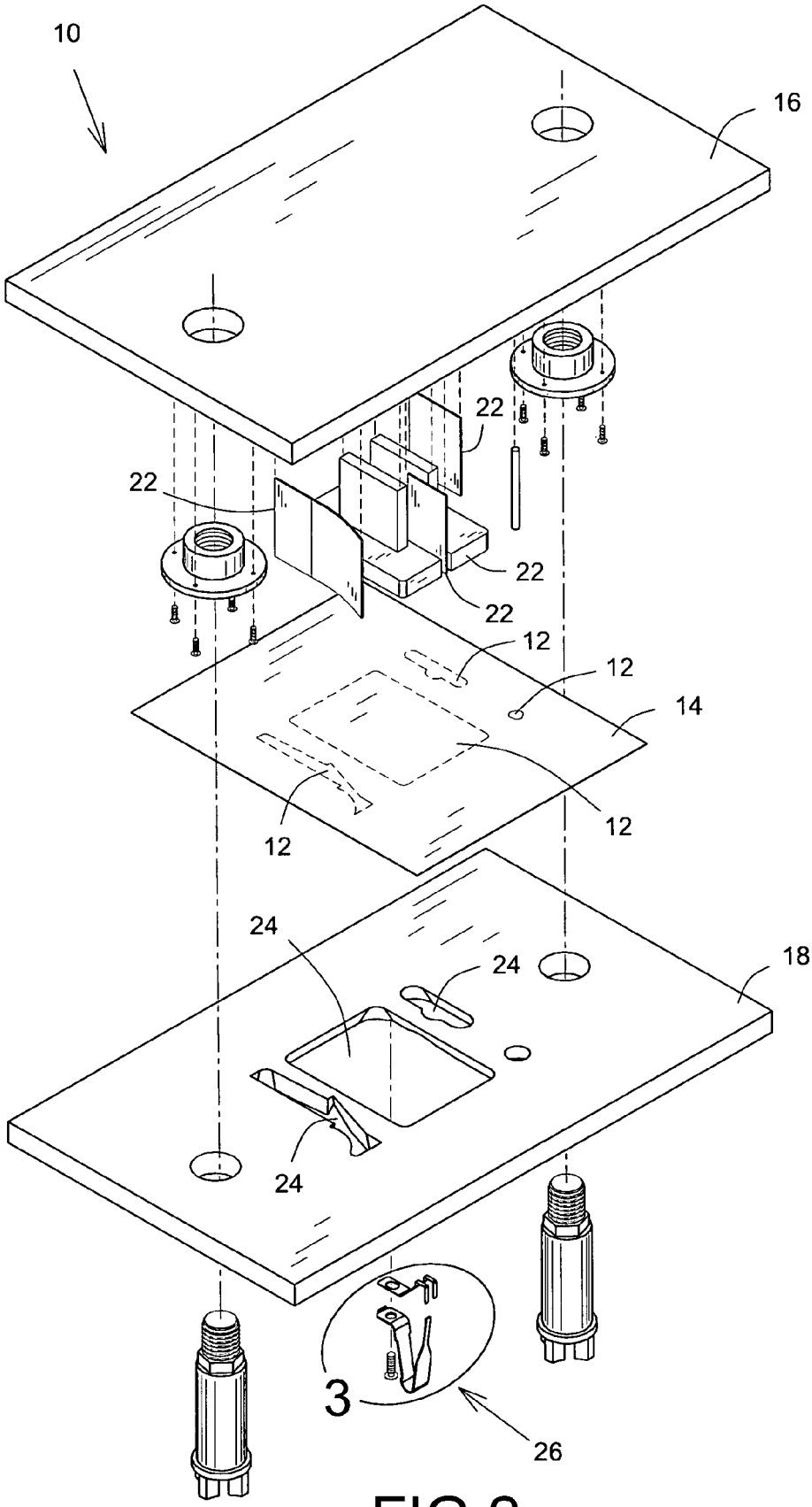
FIG. 2 is a simplified exploded view of the stripping frames showing an embodiment of a stripping device.

FIG. 2 illustrates a portion of the frames 16, 18 for ease of viewing. The frame 16 includes a number of pre-shaped male dies (punches) 22; the frame 18 includes a corresponding number of pre-shaped female body openings 24, which are complementary to the male dies 22. The dies 22 and the openings 24 are pre-shaped according to a required template design and the cutting patterns on the sheets of material 14, the dies 22 and the openings 24 being complementary to the cut-outs on in the sheet 14. While rectangular or square shaped sheets of material are illustrated throughout, it is to be understood that any type of sheet shape may be used without deviating from the scope of the present invention. Moreover, the number of body openings 24 and dies 22 may vary and depend on the design requirements of the finished template.

Figure 2A:
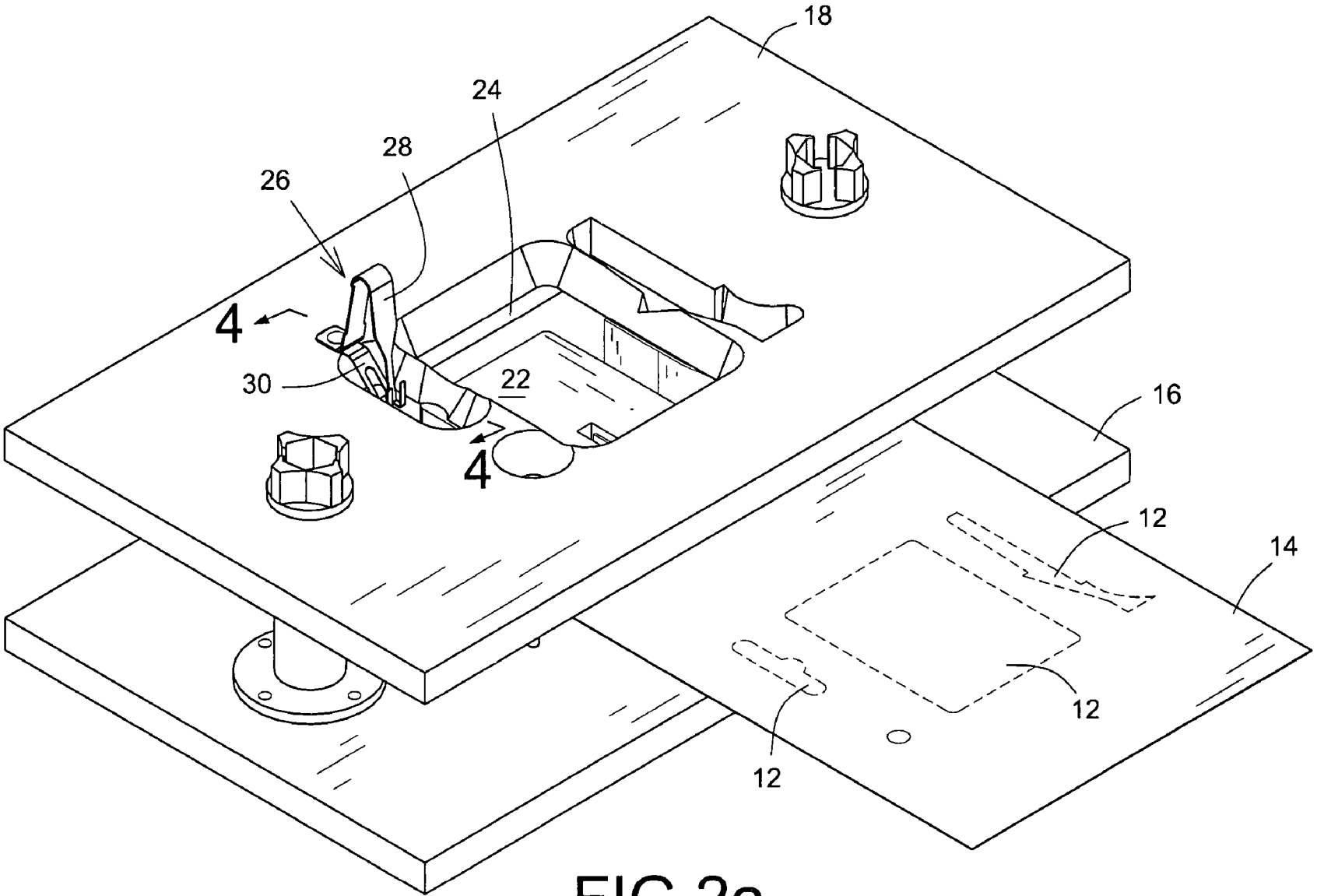
FIG. 2*a* is a perspective view of the stripping frames showing the stripping device connected to a lower stripping frame.
Figure 2B:
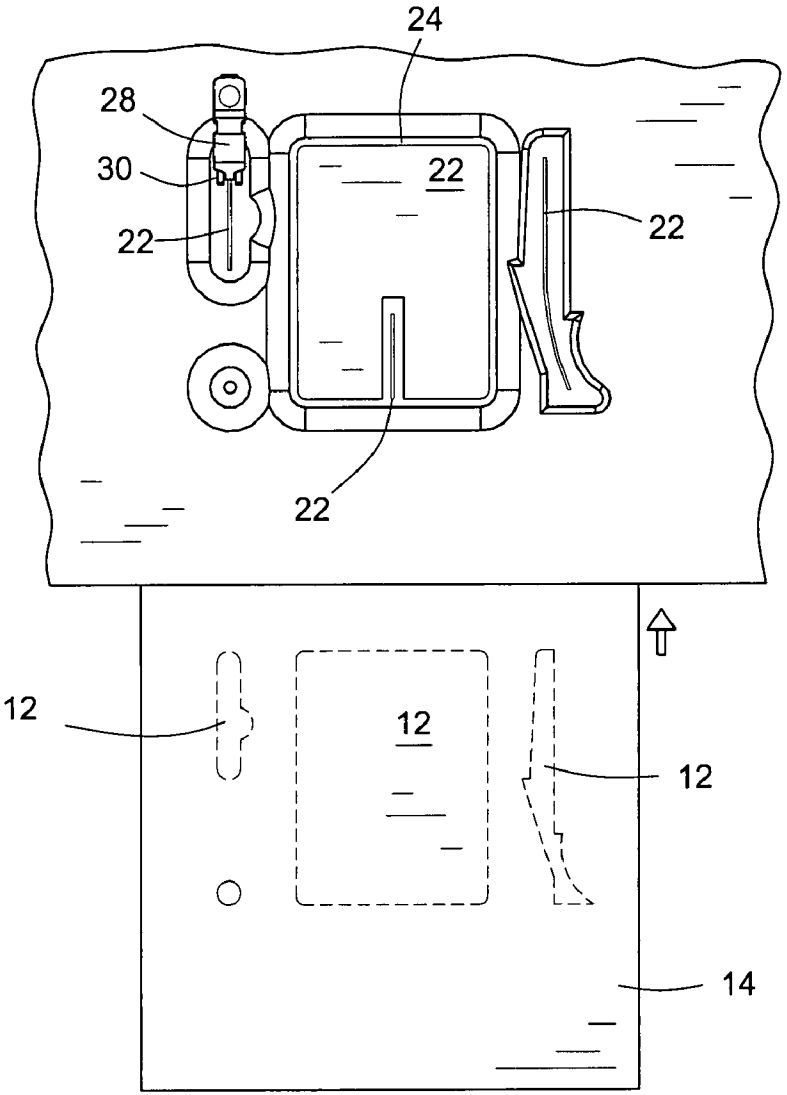
FIG. 2*b* is a bottom view of the stripping device and a sheet of pre-cut material.

Referring now to FIGS. 2 and 2*a*, an embodiment of a stripping device of the present invention is shown generally at 26 and is connected to the frame 18. Broadly speaking, the stripping device 26 includes a stripping member 28, which strips the waste piece 12 from the sheet of pre-cut material, and a blocking member 30, which blocks the waste piece 12 and prevents it from interfering with a stripping operation, as described below.

Figure 4A:
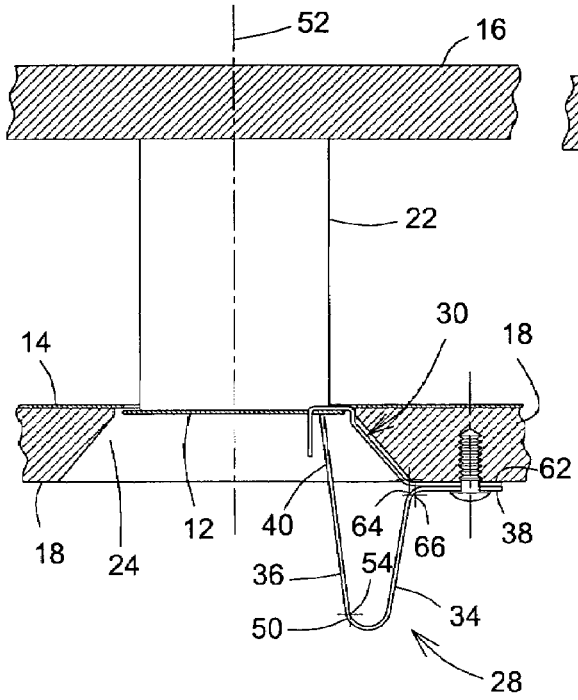
FIG. 4*a* is a simplified side view of the stripping device in a default position.
Figure 4B:
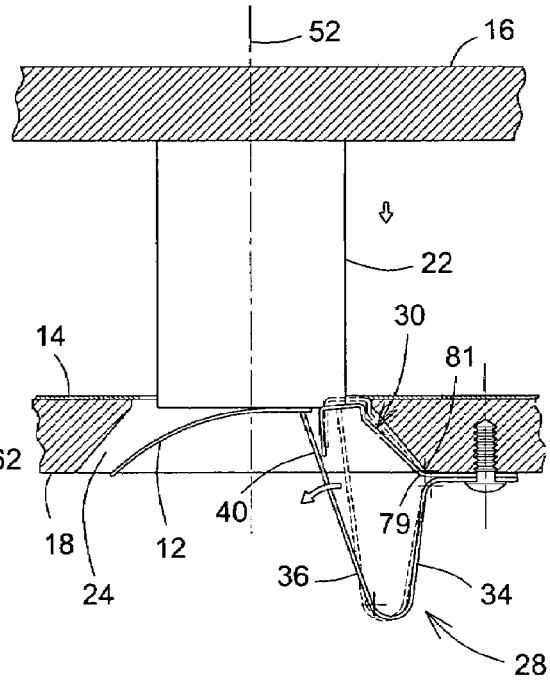
FIG. 4*b* is a simplified side view of the stripping device in an intermediate stripping position.
Figure 4C:
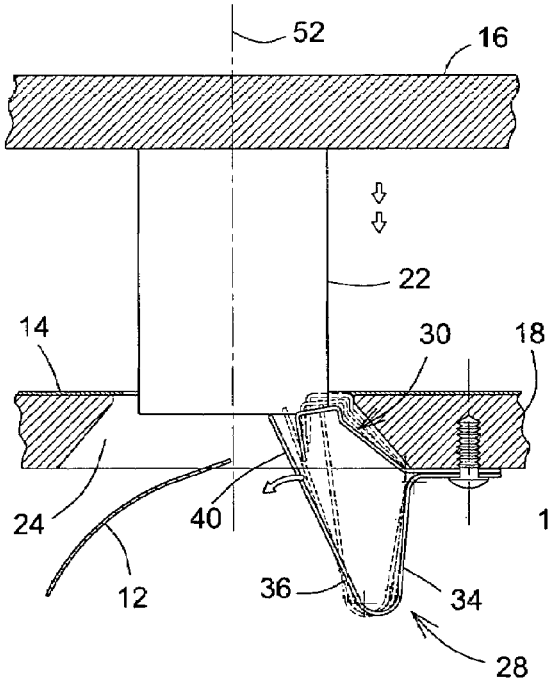
FIG. 4*c* is a simplified side view of the stripping device in a final stripping position showing a waste piece being removed from the pre-cut sheet.
Figure 4D:
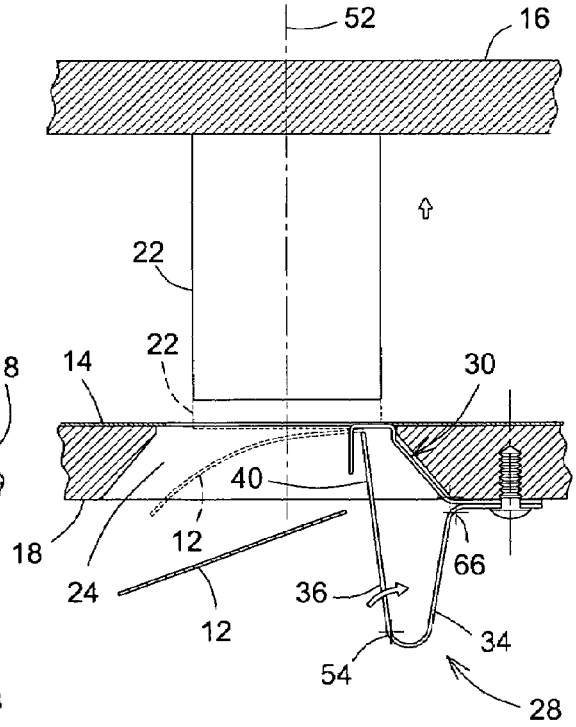
FIG. 4*d* is a simplified side view of the stripping device showing the stripped waste piece contacting the blocking member.

As best seen in FIGS. 2, 3, 4*a*, 4*b*, 4*c*, and 4*d*, the stripping member 28 includes an arcuate connecting portion 32, a supporting finger 34 located on one side of the connecting portion 32, and a stripping finger 36 located on another side of the connecting portion 32. The supporting finger 34 has a first end 38, which is connected to the frame 18 and is located adjacent the body opening 24. The stripping finger 36 has a stripping end portion 40, which is disposed at an angle towards the waste piece 12 to be stripped. The stripping member 28 is typically made from a resilient material, which in the embodiment illustrated, is a folded over single piece of hardened steel. In another aspect, the resilient material may also be a single piece of resilient plastic. In a default configuration, as illustrated in FIG. 4*a*, the inherent resilience of the folded over hardened steel piece biases the stripping end portion 40 away from the supporting finger 34 so that it contacts the waste piece 12 at an angle. As best seen in FIG. 4*c*, the resilience of the folded over piece enables the supporting finger 34 to be moved about the first end 38 with respect to the frame 18 so that it may be deflected rearwardly away from the waste piece 12 during a stripping operation. The stripping end portion 40 is disposed towards the body opening 24 so that it may contact the waste piece 12 as it moves towards the body opening 24. In the embodiment illustrated, the stripping end portion 40 is typically is disposed into the body opening 24 and inclined away from the supporting finger 34. Although a single folded over piece of resilient material is illustrated, it is also contemplated that resilient compression springs may be used to resiliently bias apart the stripping end 40 from the supporting finger 34 and to enable deflection of the supporting finger 34.

As best seen in FIGS. 3, 4*a*, 4*b*, 4*c*, and 4*d*, the stripping finger 36 has a distal portion 42, a proximal portion 44 and an intermediate portion 46. The distal portion 42 connects the stripping finger 36 to the arcuate connecting portion 32. The proximal portion 44 connects the stripping end portion 40 to the intermediate portion 46 and the intermediate portion 46 interconnects the distal portion 42 and the proximal portion 44.

In the embodiment illustrated, the intermediate portion 46 tapers away from the distal portion 42 towards the proximal portion 44, so that the proximal portion 44 is narrower than the distal portion 42. The proximal portion 44 is an elongate rectangular strip with the stripping end portion 40 located at a squared end 48 of the rectangular strip. The squared end 48 is typically sharp to enable it to dig into the waste piece 12 and to strip it from the pre-cut sheet 14. The stripping finger 36 is resiliently hinged to the arcuate connecting portion 32 to permit movement of the stripping end portion 40 relative to the supporting finger 34 between default and stripping positions. The connection between the stripping finger 36 and the arcuate connecting portion 32, because of the inherent resilience of the folded over stainless steel, operates as a first resilient hinge 50 to permit the stripping finger 36 to move relative to the supporting finger in a restricted hinging movement. The body opening 24 has an opening axis 52 and the first resilient hinge 50 has a first hinge axis 54, which is generally perpendicular to the opening axis 52.

The length of the stripping finger 36 is typically longer than the length of the supporting finger 34 so that the stripping end portion 40 is disposed below the first end 38 and into the body opening 24.

The supporting finger 34 has a distal portion 56, a proximal portion 58 and an intermediate portion 60. The distal portion 56 connects the supporting finger 34 to the arcuate portion 32, the proximal portion 58 connects the first end 38 of the supporting finger 34 to the intermediate portion 60 and the intermediate portion 60 interconnects the distal portion 56 and the proximal portion 58. The distal portion 56 and the proximal portion 58 may be tapered towards the intermediate portion 60. The intermediate portion 60 may be narrower than the distal and proximal portions. A connecting foot 62 is located at proximal portion 58 and connects the supporting finger 34 to the frame 18. The connecting foot 62 is disposed away from the body opening 24. To permit the supporting finger 34 to be deflected rearwardly away from the body opening 24, the supporting finger 34 is resiliently hinged to the frame 18 so that the supporting finger can move relative to the frame 18 between default and stripping positions. A second resilient hinge 64 is located near the connecting foot 62 and has a second hinge axis 66, which is perpendicular to the opening axis 52. The second hinge axis 66 and the first hinge axis 54 are generally parallel to each other and perpendicular to the opening axis 52.

The blocking member 30 includes a second end 68 connected to the frame 18 and a blocking portion 70. In the default configuration, the stripping finger 36 is located adjacent the blocking portion 70. The second end 68 of the blocking member 30 is located adjacent the body opening 24 so that the blocking portion 70 is disposed towards and into the body opening 24, and inclined away from the second end 68. The blocking portion 70 has a pair of blocking fingers 72, which are connected to the second end 68. The blocking fingers 72 are spaced apart and define a gap 74 therebetween. The gap 74 is of a sufficient size to permit the rectangular strip of the stripping finger 36 to move between the blocking fingers 72. Each blocking finger 72 has a proximal blocking panel 76, which contacts the waste piece 12. A blocking finger distal portion 78 resiliently and hingeably connects the blocking finger 72 to the second end 68 and an intermediate portion 80 interconnects the proximal blocking panel 76 with the distal portion 78. A third resilient hinge 79 is located between the distal portion 78 and the second end 68 to allow the blocking member 30 to move when the stripping member 28 moves during the stripping operation. The third hinge 79 has a third hinge axis 81, which is generally parallel to the first and second hinge axes 54, 66. The proximal blocking panel 76 is disposed perpendicular to the intermediate portion 80 and generally parallel to the opening axis 52. The rectangular strip of the stripping finger 36 is disposed rearwardly of the blocking fingers 72 in the default position. The blocking member 30 is typically made from a single piece of resilient stainless steel. It is also contemplated that the stripping member 28 and the blocking member 30 may be made from a single piece of resilient material, without deviating from the scope of the present invention. Moreover, in another aspect, the blocking member 30 may also be made from a piece of resilient plastic.

In the embodiment illustrated, the second end 68 of the blocking member 30 and the first end 38 of the stripping member 28 are connected together, typically using conventional securing means. It is also contemplated that the stripping member 28 and the blocking member 30 may be used together or they may be used separately.

Operation

A typical stripping operation will now be described with reference to FIGS. 2*a*, 4*a*, 4*b*, 4*c*, and 4*d*. Since the description of the operation may apply to a sheet of pre-cut material having many waste pieces to be stripped, the following refers to only one waste piece.

The stripping device 26 may begin from the default configuration, as shown in FIG. 4*a*, in which the stripping finger 36 is biased away from the supporting finger 34. With the frames 16, 18 spaced apart, a sheet of pre-cut material loads horizontally between the frames 16, 18 and is held in place by a series of guides (not shown), which correctly orientate and align the waste piece 12 with the die 22 and the opening 24. The frame 18 rapidly moves the sheet of pre-cut material towards the second frame 16 so that the waste piece 12 contacts the stripping device 26. The stripping end portion 40 of the stripping finger 36 contacts the waste piece 12 at an angle. The force of the frame 16 moving along its vertical path of travel moves the stripping finger 36 about the first hinge 50 and biases the stripping finger and thus the stripping end portion 40 further away from the supporting finger 34 so that the squared end 48 contacts the waste piece and causes the perforations connecting the waste piece 12 to the sheet 14, to rip. The squared end 48 slides along the surface of the die 22 until the waste piece is completely stripped from the sheet 14, while the supporting finger 34 is deflected rearwardly about the second hinge 64. The blocking member 30 moves together with the stripping member 28 about the third resilient hinge 79, as best illustrated by the phantom lines in FIG. 4*b*. The frame 16 moves away from the frame 18 so that the stripping finger 36 and the supporting finger 34 return to their respective default positions. The waste piece 12 often tends to be dragged back towards the blocking member 30 and may interfere with the next stripping operation. The blocking portion 70 reduces this interference by acting as a barrier against which the waste piece 12 may move so that is deflected away from the stripping device 26.

Alternatives

Figure 3:
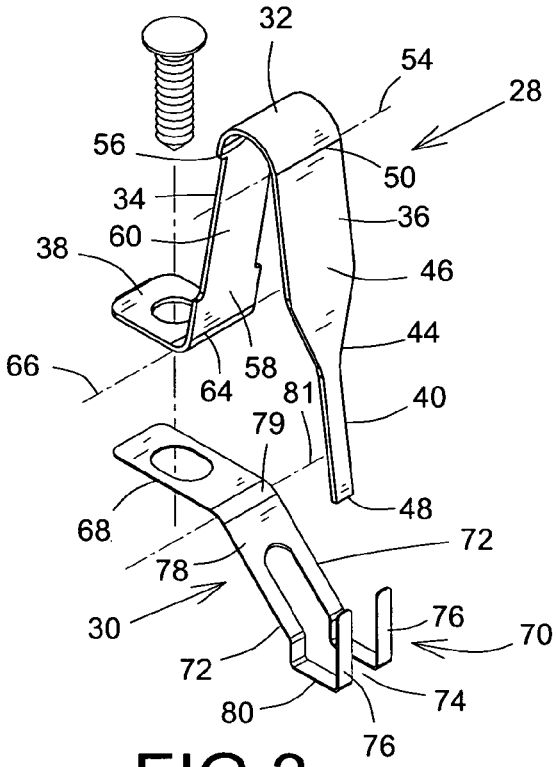
FIG. 3 is an exploded perspective view of the stripping device.
Figure 3A:
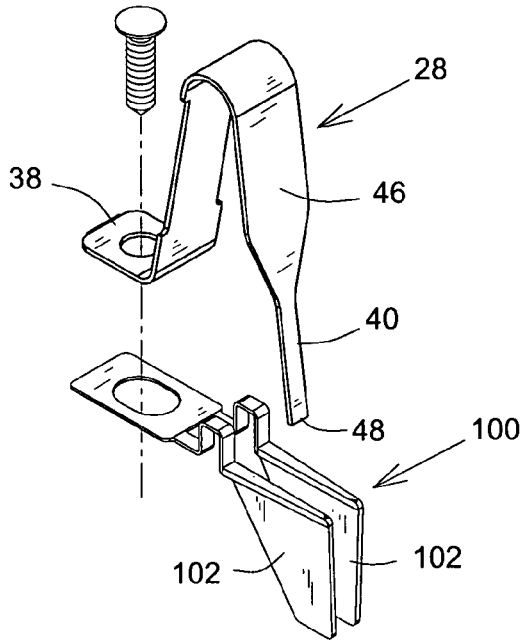
FIG. 3*a* is an exploded perspective view of an alternative blocking member.
Figure 3B:
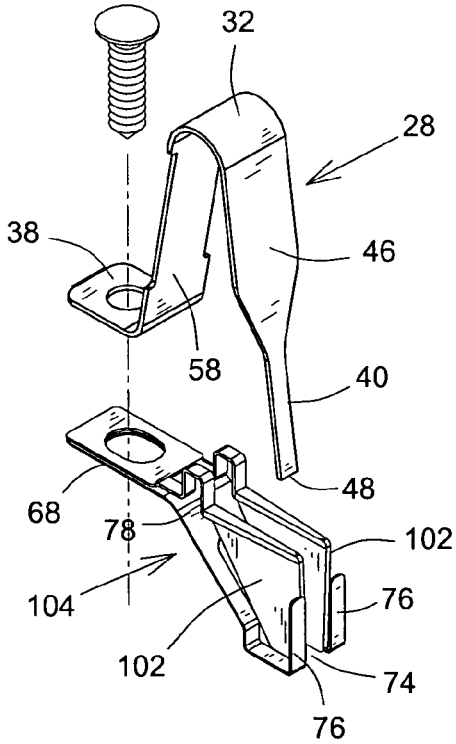
FIG. 3*b* is an exploded perspective view of another alternative blocking member.
Figure 3C:
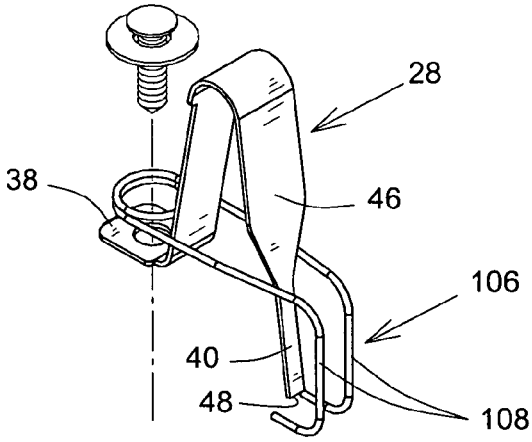
FIG. 3*c* is an exploded perspective view of another alternative blocking member.

The embodiment of the stripping device 26 described above may also be used with different designs of blocking member 30, as illustrated in FIGS. 3*a*, 3*b*, and 3*c*.

An alternative blocking member 100, as seen in FIG. 3*a*, is similar to the blocking member 30, but includes a pair of blocking panels 102 connected to the second end 68.

Another alternative blocking member 104, as seen in FIG. 3*b*, includes a combination of blocking member 100 with the blocking member 30.

Still another alternative blocking member 106 includes a pair of blocking wires 108 connected to the second end 68. The alternative blocking members 100, 104 and 106 operate essentially identically to the blocking member 30.

Figure 5:
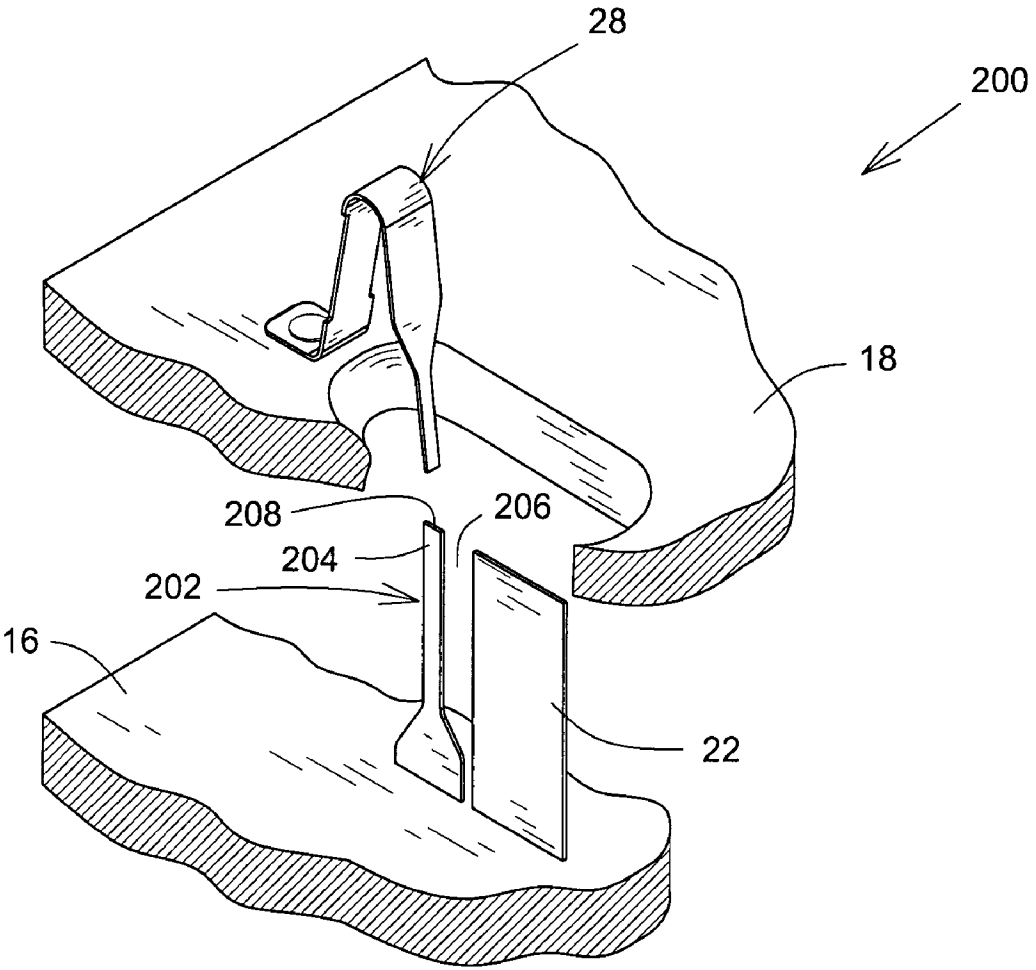
FIG. 5 is an exploded perspective view of an alternative blocking member.

An alternative embodiment of a stripping device is shown generally at 200 in FIG. 5. Briefly, the device 200 includes the stripping member 28 and a stationary abutment member 202. The stripping member 28 operates in essentially the same way as the stripping member 28 in the stripping device 26, but with some differences, which will be described below.

The abutment member 202 includes a stationary finger 204, which is fixedly connected to the press frame 16. The stationary finger 204 is located spaced apart from the die 22 to define a blocking gap 206 therebetween. The stationary finger 204 is typically tapered away from the frame 16 and towards a planar surface 208.

Figures 6A, 6B, 6C, 6D:
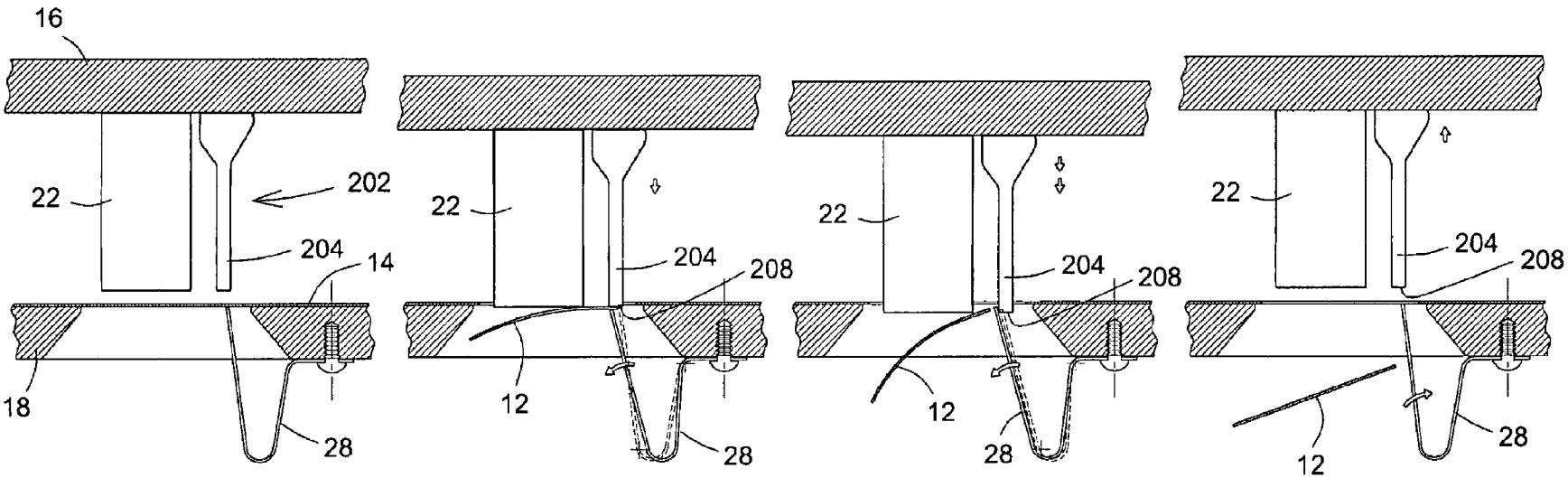
FIG. 6*a* is a simplified side view of the alternative blocking member in a default position.
FIG. 6*b* is a simplified side view of the alternative blocking member in an intermediate stripping position.
FIG. 6*c* is a simplified side view of the alternative blocking member in a final stripping position.
FIG. 6*d* is a simplified side view of the alternative blocking member showing the blocking member and the stripping member returning to the default position.

The operation of the blocking member 202 will now be described with reference to FIGS. 5, 6*a*through 6*d*. As described above for the stripping device 26, the frame 18 moves the sheet of pre-cut material towards the other frame 16 so that the waste piece contacts the stripping member 28. However, instead of the abutment member 202 being resiliently moved together with the stripping finger 36 of the stripping member 28, as described above, the abutment member 202 remains stationary such that only the resilient stripping finger 36 moves. The stripping finger 36 slides across the planar surface 208 of the abutment member 202 until it reaches the blocking gap 206, as best illustrated in FIGS. 6*b* and 6*c*. The stationary finger 204 moves the resilient stripping finger 36 partially into the blocking gap 206 and the stripping finger 36 strips the waste material 12 away from the pre-cut sheet 14. The die 22 then pushes the waste material 12 away from the pre-cut sheet of material 14 and the stripping finger 36 returns to the default position, as illustrated In FIG. 6*d*.

The stationary finger 204 blocks the waste piece, once stripped, and stops it from interfering with the next stripping operation.

While specific embodiments have been described, those skilled in the art will recognize many alterations that could be made within the spirit of the invention, which is defined solely according to the following claims.

I claim:

1. A stripping device for stripping a waste piece from a sheet of material, the device comprising:

a) a stripping member having a connecting portion, a supporting finger located on one side of the connecting portion, and a stripping finger located on another side of the connecting portion;

b) a frame having a planar body having at least one body opening located therein, and a die connected thereto and in register with the body opening, the die having a planar surface substantially facing the stripping finger;

c) the supporting finger having a first end connected to the frame, the supporting finger being movable about the first end with respect to the frame;

d) the stripping finger having a stripping end portion, the stripping end portion being disposed towards the body opening in alignment with the die and being biased away from the supporting finger for contacting at an angle the waste piece to be stripped, the stripping end portion being slidable relative to and along the planar surface of the die with the waste piece therebetween to deflect the waste piece as the waste piece moves towards the body opening, the stripping end portion being movable further away from the supporting finger and against the waste piece so as to strip the waste piece, the body opening receiving the waste piece, the stripping end portion slidably and directly contacting the planar surface of the die after stripping of the waste piece.

2. The device, according to claim 1, in which:

a) the first end of the supporting finger is located adjacent the body opening.

3. The device, according to claim 2, in which:

a) the stripping end portion is disposed into the body opening and inclined away from the supporting finger.

4. The device, according to claim 1, in which:

a) the connecting portion is an arcuate portion, the supporting finger and the stripping finger being connected to each end of the arcuate portion.

5. The device, according to claim 4, in which the stripping finger has:

a) a distal portion for connecting the stripping finger to the arcuate portion;

b) an intermediate portion; and c) a proximal portion for connecting the stripping end portion to the intermediate portion, the intermediate portion interconnecting the distal portion and the proximal portion.

6. The device, according to claim 5, in which:

a) the intermediate portion tapers away from the distal portion towards the proximal portion, the proximal portion being narrower than the distal portion.

7. The device, according to claim 4, in which:

a) the proximal portion is an elongate rectangular strip, the stripping end portion being located at a squared end of the rectangular strip.

8. The device, according to claim 1, in which:

a) the stripping finger is resiliently hinged to the connecting portion to permit movement of the stripping end portion relative to the supporting finger between default and stripping positions.

9. The device, according to claim 8, in which:

a) the stripping finger is resiliently hinged about a first resilient hinge.

10. The device, according to claim 9, in which:

a) the first resilient hinge has a first hinge axis which is perpendicular to the opening axis.

11. The device, according to claim 1, in which the supporting finger has:

a) a distal portion for connecting the supporting finger to the connecting portion;

b) an intermediate portion; and c) a proximal portion for connecting the first end of the supporting finger to the intermediate portion, the intermediate portion interconnecting the distal portion and the proximal portion.

12. The device, according to claim 11, in which:

a) the distal portion and the proximal portion taper towards the intermediate portion, the intermediate portion being narrower than the distal and proximal portions.

13. The device, according to claim 12, in which:

a) the distal portion has a connecting foot connected to the frame and disposed away from the body opening.

14. The device, according to claim 1, in which:

a) the supporting finger is resiliently hinged to the frame to permit movement of the supporting finger relative to the frame between default and stripping positions.

15. The device, according to claim 14, in which:

a) the supporting finger is resiliently hinged about a second resilient hinge.

16. The device, according to claim 15, in which:

a) the body opening has an opening axis; and b) the second resilient hinge has a second hinge axis which is perpendicular to the opening axis.

17. The device, according to claim 15, in which:

a) the stripping finger has a first resilient hinge with a first hinge axis;

b) the second hinge axis and the first hinge axis being parallel to each other, the first and second hinge axes being perpendicular to the opening axis.

18. The device, according to claim 1, in which:

a) the length of the stripping finger is longer than the length of the supporting finger.

19. The device, according to claim 1, in which:

a) the stripping end portion is disposed below the first end.

20. The device, according to claim 1, in which:

a) the stripping member is made from a single piece of forded over material.

21. The device, according to claim 1, in which:

a) the stripping member is made from a single piece of folded over resilient material.

22. The device, according to claim 21, in which:

a) the resilient material is hardened steel.

23. The device, according to claim 21, in which:

a) the resilient material is plastic.

24. The device, according to claim 1, further includes:

a) a blocking member for blocking the waste piece after it has been stripped, the blocking member having a second end connected to the frame and a blocking portion, the blocking member being movable about the second end, the stripping finger being locatable adjacent the blocking portion.

25. The device, according to claim 24, in which:

a) the second end of the blocking member is located adjacent the body opening and the blocking portion is disposed towards the body opening.

26. The device, according to claim 25, in which:

a) the blocking portion is disposed into the body opening and inclined away from the second end.

27. The device, according to claim 24, in which:

a) the stripping finger has a proximal portion, the proximal portion being an elongate rectangular strip;

b) the blocking portion having a pair of blocking fingers connected to the second end, the blocking fingers being spaced apart to define a gap therebetween, the gap being of sufficient size to permit the rectangular strip to move between the blocking fingers.

28. The device, according to claim 27, in which each blocking finger has:

a) a proximal blocking panel for contacting the waste piece;

b) a distal portion for connecting the blocking finger to the second end;

c) an intermediate portion interconnecting the proximal blocking panel with the distal portion.

29. The device, according to claim 28, in which:

a) the proximal blocking panel is disposed perpendicular to the intermediate portion.

30. The device, according to claim 29, in which:

a) the body opening has an opening axis;

b) the proximal blocking panel is disposed parallel to the opening axis.

31. The device, according to claim 27, in which:

a) the rectangular strip is disposed rearwardly of the blocking fingers in the default position.

32. The device, according to claim 28, in which:

a) the distal portion is resiliently hinged to the second end to permit movement of the blocking fingers relative to the second end between default and stripping positions.

33. The device, according to claim 32, in which:

a) the distal portion is resiliently hinged about a third resilient hinge.

34. The device, according to claim 24, in which:

a) the second end of the blocking member and the first end of the stripping member are connected together.

35. The device, according to claim 24, in which:

a) the stripping finger has a proximal portion, the proximal portion being an elongate rectangular strip;

b) the blocking portion having a pair of blocking panels connected to the second end, the blocking panels being spaced apart to define a gap therebetween, the gap being of sufficient size to permit the rectangular strip to move between the blocking panels.

36. The device, according to claim 24, in which:

a) the stripping finger has a proximal portion, the proximal portion being an elongate rectangular strip;

b) the blocking portion having a pair of blocking wires connected to the second end, the blocking fingers being spaced apart to define a gap therebetween, the gap being of sufficient size to permit the rectangular strip to move between the blocking wires.

37. The device, according to claim 24, in which:

a) the blocking member is made from a single piece of resilient material.

38. The device, according to claim 37, in which:

a) the resilient material is stainless steel.

39. The device, according to claim 37, in which:

a) the resilient material is plastic.

40. The device, according to claim 1, in which:

a) the sheet of material is pre-cut paperboard, the waste piece being partially connected within the paperboard.

41. The device, according to claim 1, in which:

a) a blocking member for blocking the waste piece after it has been stripped, the blocking member having a stationary finger fixedly connected to the frame, the stationary finger being spaced apart from the die and defining a blocking gap therebetween.

42. The device, according to claim 41, in which:

a) the stationary finger includes a planar surface, the stationary finger being tapered away from the frame towards the planar surface, the stripping finger being slidable along the planar surface towards the blocking gap during a stripping operation.

43. A stripping device for use in a die cutting press, for stripping a waste piece from a pre-cut sheet, the press having a first frame having at least one frame opening therein and a second frame having at least one punch complementary with the frame opening, the frames being movable with respect to each other, the punch being cooperable with the frame opening, the device comprising:

a) a folded over piece of resilient material having a supporting finger located on one side of the fold, and a stripping finger located on another side of the fold, the supporting finger having a first end connected to the first frame, the supporting finger being movable about the first end with respect to the first frame, the stripping finger having a stripping end portion, the stripping end portion being resiliently biased away from the supporting finger for contacting at an angle the waste piece to be stripped, the stripping end portion being slidable along the punch to deflect the waste piece, the stripping end portion being movable further away from the supporting finger and against the waste piece so as to strip the waste piece;

b) a blocking member for blocking the waste piece after it has been stripped, the blocking member having a second end connected to the frame and a pair of blocking fingers resiliently hinged to the second end, the blocking fingers being spaced apart to define a gap therebetween, the gap being of sufficient size to permit the stripping end portion to move between the blocking fingers.

44. The device, according to claim 43, in which:

a) the first end and the second end are connected together.

45. The device, according to claim 43, in which:

a) the fold is arcuate.

46. A stripping device for use in a die cutting press, for stripping a waste piece from a pre-cut sheet, the press having a first frame having at least one frame opening therein and a second frame having at least one punch complementary with the frame opening, the frames being movable with respect to each other, the punch being cooperable with the frame opening, the device comprising:

a) a folded over piece of resilient material having a supporting finger located on one side of the fold, and a stripping finger located off another side of the fold, the supporting finger having a first end connected to the first frame, the supporting finger being movable about the first end with respect to the first frame, the stripping finger having a stripping end portion, the stripping end portion being resiliently biased away from the supporting finger for contacting at an angle the waste piece to be stripped, the supporting finger being deflectable away from the waste piece, the stripping end portion being movable further away from the supporting finger;

b) an abutment member for blocking the waste piece after it has been stripped, the abutment member having a stationary finger fixedly connected to the second frame, the stationary finger being spaced apart from the punch and defining a blocking gap therebetween, the stationary finger includes a planar surface, the stationary finger being tapered away from the second frame towards the planar surface, the stripping end portion being slidable along the planar surface against the waste piece towards the blocking gap so as to strip the waste piece.

* * * * *